US010801524B2

(12) United States Patent
Nakano et al.

(10) Patent No.: US 10,801,524 B2
(45) Date of Patent: Oct. 13, 2020

(54) HYDRAULIC WORK MACHINE

(71) Applicant: Hitachi Construction Machinery Co., Ltd., Taito-ku, Tokyo (JP)

(72) Inventors: Hisami Nakano, Tsuchiura (JP); Hidekazu Moriki, Mito (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/490,203

(22) PCT Filed: Aug. 9, 2018

(86) PCT No.: PCT/JP2018/029861
§ 371 (c)(1),
(2) Date: Aug. 30, 2019

(87) PCT Pub. No.: WO2019/039294
PCT Pub. Date: Feb. 28, 2019

(65) Prior Publication Data

US 2020/0011030 A1 Jan. 9, 2020

(30) Foreign Application Priority Data

Aug. 24, 2017 (JP) ..... 2017-161634

(51) Int. Cl.
*F15B 11/044* (2006.01)
*F15B 11/028* (2006.01)
(Continued)

(52) U.S. Cl.
CPC ..... *F15B 11/044* (2013.01); *F15B 11/028* (2013.01); *F15B 11/16* (2013.01);
(Continued)

(58) Field of Classification Search
CPC ..... F15B 11/044; F15B 11/16; F15B 11/17
(Continued)

(56) References Cited

U.S. PATENT DOCUMENTS 5,941,155 A 8/1999 Arai et al.
6,467,264 B1 * 10/2002 Stephenson ..... F15B 11/006 60/368
(Continued)

FOREIGN PATENT DOCUMENTS

JP 3-275818 A 12/1991
JP 8-128406 A 5/1996
(Continued)

OTHER PUBLICATIONS

International Search Report (PCT/ISA/210) issued in PCT Application No. PCT/JP2018/029861 dated Nov. 6, 2018 with English translation (four (4) pages).
(Continued)

*Primary Examiner* — Michael Leslie
(74) *Attorney, Agent, or Firm* — Crowell & Moring LLP

(57) ABSTRACT

A hydraulic work machine is provided which can improve the finishing accuracy in a horizontally leveling work, a slope face shaping work and so forth by preventing sudden acceleration of an arm when the excavation load decreases suddenly. The hydraulic work machine includes an arm velocity-control valve device 22 capable of adjusting a meter-out opening of the arm cylinder independently of a first arm directional control valve 23. A controller 100 is configured to control, when correcting and increasing an operation amount instructed by the first arm directional control valve, the arm velocity-control valve device to decrease the meter-out opening of the arm cylinder in response to the increase of load pressure of the arm cylinder.

4 Claims, 10 Drawing Sheets

(51) Int. Cl.
*F15B 11/16* (2006.01)
*F15B 11/17* (2006.01)

(52) U.S. Cl.
CPC ..... *F15B 11/17* (2013.01); *F15B 2211/353* (2013.01); *F15B 2211/46* (2013.01)

(58) Field of Classification Search
USPC ..... 60/422
See application file for complete search history.

(56) References Cited

U.S. PATENT DOCUMENTS

| | | | | |
|---|---|---|---|---|
| 6,502,393 | B1 * | 1/2003 | Stephenson | F15B 11/006 60/414 |
| 7,162,869 | B2 * | 1/2007 | Yoshino | E02F 9/2242 60/414 |
| 9,383,287 | B2 * | 7/2016 | Rannow | F15B 19/002 |
| 10,472,804 | B2 * | 11/2019 | Yamashita | F15B 19/005 |
| 10,604,914 | B2 * | 3/2020 | Moriki | E02F 9/20 |
| 2016/0047398 | A1 | 2/2016 | Cho et al. | |
| 2019/0338494 | A1 * | 11/2019 | Moriki | F15B 11/17 |

FOREIGN PATENT DOCUMENTS

| | | | |
|---|---|---|---|
| JP | 9-291560 | A | 11/1997 |
| JP | 11-30204 | A | 2/1999 |
| JP | 2000-8423 | A | 1/2000 |
| JP | 2001-330006 | A | 11/2001 |

OTHER PUBLICATIONS

Japanese-language Written Opinion (PCT/ISA/237) issued in PCT Application No. PCT/JP2018/029861 dated Nov. 6, 2018 (three (3) pages).

International Preliminary Report on Patentability (PCT/IB/338 & PCT/IB/373) issued in PCT Application No. PCT/JP2018/029861 dated Mar. 5, 2020, including English translation of document C2 (Japanese-language Written Opinion (PCT/ISA/237) previously filed on Aug. 30, 2019) (six (6) pages).

* cited by examiner (PRESENT INVENTION)

HYDRAULIC WORK MACHINE

TECHNICAL FIELD

The present invention relates to a hydraulic work machine such as a hydraulic excavator.

BACKGROUND ART

In a hydraulic work machine, hydraulic fluid delivered from a hydraulic pump is supplied to an actuator through a directional control valve and a work device acts. The directional control valve acts by an operation pressure according to an operation amount of an operation device and controls the flow rate and the direction of the hydraulic fluid to be supplied to the actuator. The action velocity and direction of the work device are controlled by the flow rate and the direction of the hydraulic fluid supplied to the actuator.

In a hydraulic circuit of a general hydraulic work machine, a plurality of directional control valves are connected in parallel to one hydraulic pump. The directional control valves are connected to individually different actuators and shunt a flow of hydraulic fluid supplied from the hydraulic pump, and supply the hydraulic fluid to the actuators. Such a configuration as just described makes it possible to allow the plurality of actuators to act with the single hydraulic pump and allow the directional control valves to control the action velocity of the actuators.

Patent Document 1 discloses a locus controller for a construction machine capable of controlling the locus of the work device distal end of a hydraulic construction machine to a target locus. This locus controller calculates the position and the posture of each of the members configuring the work device and corrects the operation pressure to be outputted from the operation device such that the work device distal end acts along the target locus.

PRIOR ART DOCUMENT

Patent Document

Patent Document 1: JP-9-291560-A

SUMMARY OF THE INVENTION

Problem to be Solved by the Invention

In a conventional hydraulic system, hydraulic fluid supplied from a single hydraulic pump is shunted by a directional control valve to cause a plurality of actuators to act. The shunt rate to each actuator varies depending upon the rate of the opening of the directional control valve and the rate of the load applied to the actuator. Therefore, in the case where the excavation load fluctuates during excavation, the shunt rates to the actuators vary, the velocity balance between the actuators is lost and the deviation between the locus of the work device distal end and the target locus becomes great.

Description is given taking a case in which a work device is driven to act by a boom cylinder and an arm cylinder to perform excavation as an example. As the excavation load increases, the load on the arm cylinder increases. As the load increases, the shunt rate to the arm cylinder decreases and the expansion velocity of the arm cylinder decreases, and thereupon, the deviation between the locus of the work device distal end and the target locus increases. At this time, in the hydraulic system described in Patent Document 1, the operation pressure is corrected such that, when the load to the arm cylinder increases, the meter-in opening of the directional control valve for controlling the arm cylinder is increased to increase the shunt rate to the arm cylinder. This makes it possible to maintain, also when the excavation load increases, the velocity balance between the arm cylinder and the boom cylinder and to allow the bucket distal end to move along the target locus.

However, if the excavation load decreases suddenly by such an event that the excavation target becomes soft or the bucket distal end comes out of the surface of the excavation target, then a large amount of hydraulic fluid is supplied to the arm cylinder through the meter-in opening of the expanded arm directional control valve, resulting in the possibility that the arm may be suddenly accelerated in the crowding direction. As a result, in the case where the bucket distal end is deviated by a great amount from the target locus or the advancing direction of the bucket distal end and the target locus cross with each other, the bucket will excavate deeper than the target locus.

The present invention has been made in view of such a problem as described above, and it is an object of the present invention to provide a hydraulic work machine that can improve the finishing accuracy in a horizontally leveling work, a slope face shaping work and so forth by preventing sudden acceleration of the arm when the excavation load decreases suddenly.

Means for Solving the Problem

In order to attain the object described above, according to the present invention, there is provided a hydraulic work machine including a work device including a boom and an arm, a boom cylinder that drives the boom, an arm cylinder that drives the arm, a hydraulic operating fluid tank, a first hydraulic pump, a first boom directional control valve that controls a flow rate and a direction of hydraulic fluid to be supplied from the first hydraulic pump to the boom cylinder, a first arm directional control valve that controls a flow rate and a direction of hydraulic fluid to be supplied from the first hydraulic pump to the arm cylinder, a boom operation device that gives instructions on an operation amount of the first boom directional control valve, an arm operation device that gives instructions on an operation amount of the first arm directional control valve, a boom load pressure sensor that detects a load pressure of the boom cylinder, an arm load pressure sensor that detects a load pressure of the arm cylinder, and a controller configured to correct and increase an operation amount of the first arm directional control valve, the operation amount being instructed by the arm operation device, such that a meter-in opening of the arm cylinder increases in response to the increase of a deviation of the load pressure of the arm cylinder with respect to the load pressure of the boom cylinder, wherein the hydraulic work machine further comprises an arm velocity-control valve device capable of adjusting a meter-out opening of the arm cylinder independently of the first arm directional control valve, and the controller controls, when correcting and increasing the operation amount instructed by the arm operation device, the arm velocity-control valve device to decrease the meter-out opening of the arm cylinder in response to the increase of the load pressure of the arm cylinder.

According to the present invention configured in such a manner as described above, when the operation amount instructed by the arm operation device is corrected to increase such that the meter-in opening of the first arm directional control valve increases in response to the increase of the deviation of the load pressure of the arm cylinder with respect to the load pressure of the boom cylinder (or excavation load), the meter-out opening of the arm cylinder decreases in response to the increase of the load pressure of the arm cylinder. Consequently, when the excavation load decreases suddenly, the back pressure of the arm cylinder increases and the flow rate of hydraulic fluid to be supplied to the arm cylinder is suppressed. Therefore, sudden acceleration of the arm is prevented, and the finishing accuracy in a horizontally leveling work, a slope face shaping work and so forth can be improved.

Advantages of the Invention

According to the present invention, by preventing sudden acceleration of the arm when the excavation load decreases suddenly, the finishing accuracy in a horizontally leveling work, a slope face shaping work and so forth can be improved.

MODES FOR CARRYING OUT THE INVENTION

Figure 1:
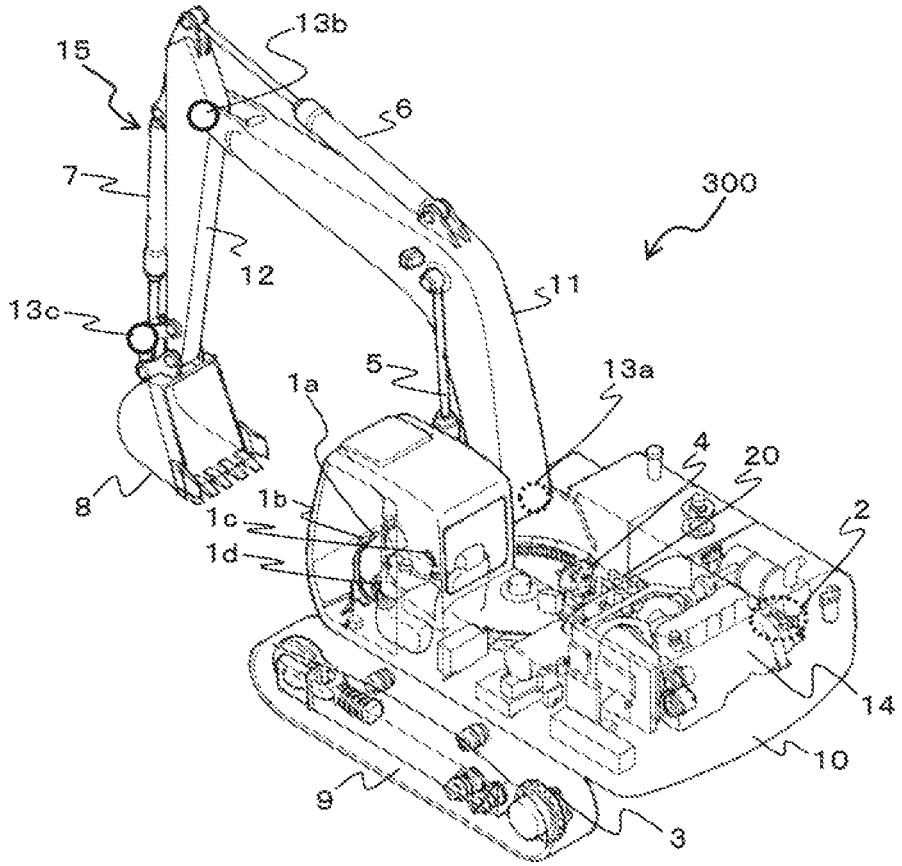
FIG. 1 is a perspective view of a hydraulic excavator according to a first embodiment of the present invention.

In the following, a hydraulic work machine according to an embodiment of the present invention is described with reference to the drawings, taking a hydraulic excavator as an example. It is to be noted that, in the figures, like elements are denoted by like reference characters and overlapping description is suitably omitted.

First Embodiment

FIG. 1 is a perspective view of a hydraulic excavator according to a first embodiment of the present invention.

Referring to FIG. 1, the hydraulic excavator 300 includes a lower track structure 9, an upper swing structure 10 and a work device 15. The lower track structure 9 has left and right crawler type track devices and is driven by left and right travelling hydraulic motors 3 (only a left side one is depicted). The upper swing structure 10 is mounted swingably on the lower track structure 9 and is driven to swing by a swinging hydraulic motor 4. In a machine chamber provided on the upper swing structure 10, an engine 14 as a prime mover, a hydraulic pump device 2 driven by the engine 14 and a control valve 20 hereinafter described are arranged.

The work device 15 is attached in a manner capable of rotating in upward and downward directions to a front portion of the upper swing structure 10. An operation room is provided on the upper swing structure 10, and operation devices such as a traveling right operation lever device 1*a*, a traveling left operation lever device 1*b*, a right operation lever device 1*c* and a left operation lever device 1*d* for giving instructions on an action and a swinging action of the work device 15, respectively, a mode setting switch 32 (depicted in FIG. 2) hereinafter described are arranged in the operation room.

The work device 15 is an articulated structure including a boom 11, an arm 12 and a bucket 8. The boom 11 rotates in upward and downward directions with respect to the upper swing structure 10 by expansion and contraction of a boom cylinder 5; the arm 12 rotates in upward, downward and forward, rearward directions with respect to the boom 11 by expansion and contraction of an arm cylinder 6; and the bucket 8 rotates in upward, downward and forward, rearward directions with respect to the arm 12 by expansion and contraction of a bucket cylinder 7.

Further, in order to compute the position of the work device 15, a boom angle sensor 13*a* for detecting the angle of the boom 11 is provided in the proximity of the connecting portion between the upper swing structure 10 and the boom 11; an arm angle sensor 13*b* for detecting the angle of the arm 12 is provided in the proximity of the connecting portion between the boom 11 and the arm 12; and a bucket angle sensor 13*c* for detecting the angle of the bucket 8 is provided in the proximity of the connecting portion between the arm 12 and the bucket 8. Angle signals outputted from the angle sensors 13*a*, 13*b* and 13*c* are inputted to a main controller 100 hereinafter described.

The control valve 20 controls the flow (the flow rate and the direction) of the hydraulic fluid to be supplied from the hydraulic pump device 2 to the hydraulic actuators such as the boom cylinder 5, the arm cylinder 6, the bucket cylinder 7, the left and right travelling hydraulic motors 3 described hereinabove.

Figure 2:
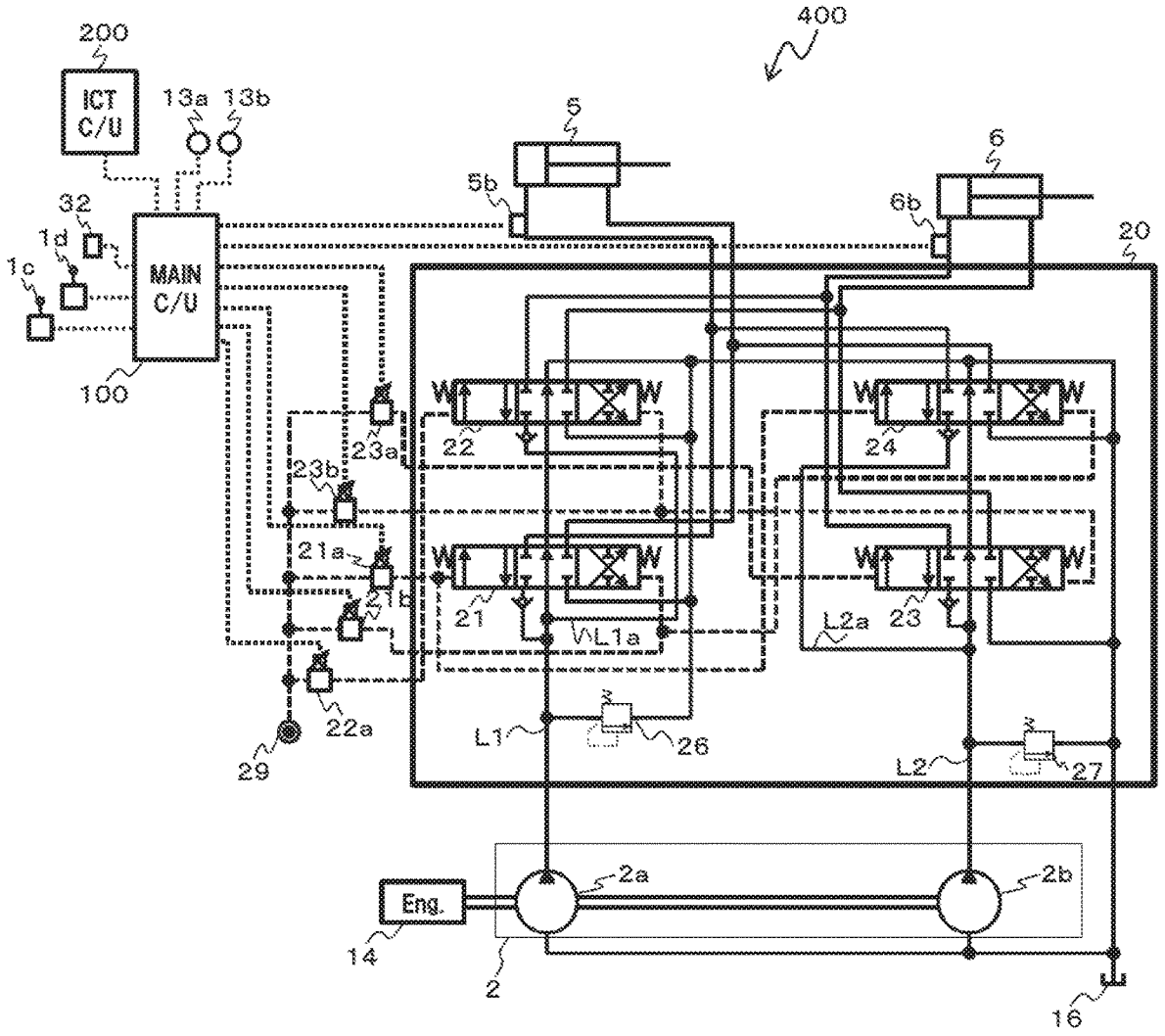
FIG. 2 is a schematic block diagram of a hydraulic drive system incorporated in the hydraulic excavator depicted in FIG. 1.

FIG. 2 is a schematic block diagram of a hydraulic drive system incorporated in the hydraulic excavator 300. It is to be noted that, for simplified description, FIG. 2 depicts only the elements relating to the driving of the boom cylinder 5 and the arm cylinder 6, and description of the other elements relating to the driving of the other hydraulic actuators is omitted. Further, also description of a drain circuit that has no direct connection with the present embodiment and a load check valve and so forth that are similar in configuration and action to a conventional hydraulic drive system is omitted.

Referring to FIG. 2, a hydraulic drive system 400 includes the hydraulic actuators 5 and 6, the hydraulic pump device 2, the control valve 20, and a main controller 100 as a controller. The hydraulic pump device 2 includes a first hydraulic pump 2*a* and a second hydraulic pump 2*b*. The first hydraulic pump 2*a* and the second hydraulic pump 2*b* are driven by the engine 14 and supply hydraulic fluid to a first pump line L1 and a second pump line L2, respectively. While, in the present embodiment, the first hydraulic pump 2*a* and the second hydraulic pump 2*b* are configured from a fixed displacement hydraulic pump, the present invention is not limited to this, and they may be configured otherwise from a variable displacement hydraulic pump.

The control valve 20 is configured from two pump lines including the first pump line L1 and the second pump line L2. In the first pump line L1, a first boom directional control valve 21 and an arm crowding velocity-control directional control valve 22 as an arm velocity-control valve device are provided, and the hydraulic fluid delivered from the first hydraulic pump 2*a* is supplied to the boom cylinder 5 through the first boom directional control valve 21 and is supplied to the arm cylinder 6 through the arm crowding velocity-control directional control valve 22. Similarly, in the second pump line L2, an arm directional control valve 23 and a second boom directional control valve 24 are provided, and the hydraulic fluid delivered from the second hydraulic pump 2*b* is supplied to the arm cylinder 6 through the arm directional control valve 23 and is supplied to the boom cylinder 5 through the second boom directional control valve 24. It is to be noted that the first boom directional control valve 21 and the arm crowding velocity-control directional control valve 22 are configured in such a way as to be capable of shunting by a parallel circuit L1*a*, and the arm directional control valve 23 and the second boom directional control valve 24 are configured in such a way as to be capable of shunting by a parallel circuit L2*a*.

Further, relief valves 26 and 27 are provided for the first pump line L1 and the second pump line L2, respectively. The relief valve 26 (27) is opened to release the hydraulic fluid of the first pump line L1 (L2) to a hydraulic operating fluid tank 16 when the pressure of the first pump line L1 (L2) reaches a relief pressure set in advance.

The first boom directional control valve 21 and the second boom directional control valve 24 are driven in a boom raising direction (in the rightward direction in FIG. 2) by a signal pressure generated by a solenoid proportional valve 21*a*, and are driven in a boom lowering direction (in the leftward direction in FIG. 2) by a signal pressure generated by a solenoid proportional valve 21*b*. The arm directional control valve 23 and the arm crowding velocity-control directional control valve 22 are driven in an arm dumping direction (in the leftward direction in FIG. 2) by a signal pressure generated by a solenoid proportional valve 23*b*. The arm directional control valve 23 is driven in an arm crowding direction (in the rightward direction in FIG. 2) by a signal pressure generated by a solenoid proportional valve 23*a*. The arm crowding velocity-control directional control valve 22 is driven in an arm crowding direction (in the rightward direction in FIG. 2) by a signal pressure generated by a solenoid proportional valve 22*a*.

The solenoid proportional valves 21*a*, 21*b*, 22*a*, 23*a* and 23*b* output to the directional control valves 21 to 24 signal pressures generated by reducing pilot hydraulic fluid supplied from a pilot hydraulic fluid source 29 as a primary pressure in response to command current from the main controller 100.

The right operation lever device 1*c* outputs a voltage signal according to an operation amount and an operation direction of its operation lever as a boom operation signal to the main controller 100. Similarly, the left operation lever device 1*d* outputs a voltage signal according to an operation amount and an operation direction of its operation lever as an arm operation signal to the main controller 100. In particular, the right operation lever device 1*c* configures a boom operation device and the left operation lever device 1*d* configures an arm operation device.

The main controller 100 receives, as inputs thereto, a semiautomatic control validity flag from the mode setting switch 32, target face information from an information controller 200, a boom angle signal from the boom angle sensor 13*a*, an arm angle signal from the arm angle sensor 13*b*, a boom bottom pressure from a boom bottom pressure sensor 5*b* as a boom load pressure sensor and an arm bottom pressure from an arm bottom pressure sensor 6*b* as an arm load pressure sensor and outputs command signals for controlling the solenoid proportional valves 21*a* to 23*b* in response to the input signals. It is to be noted that the arm bottom pressure sensor 6*b* is excavation load detection means described in the claims. Further, description of calculation performed by the information controller 200 is omitted because the calculation has no direct connection with the present invention.

It is to be noted that the mode setting switch 32 is arranged in the operation room and makes it possible to select whether to validate semiautomatic control in a work of the hydraulic excavator 300, and selects true: semiautomatic control valid or false: semiautomatic control invalid.

Figure 3:
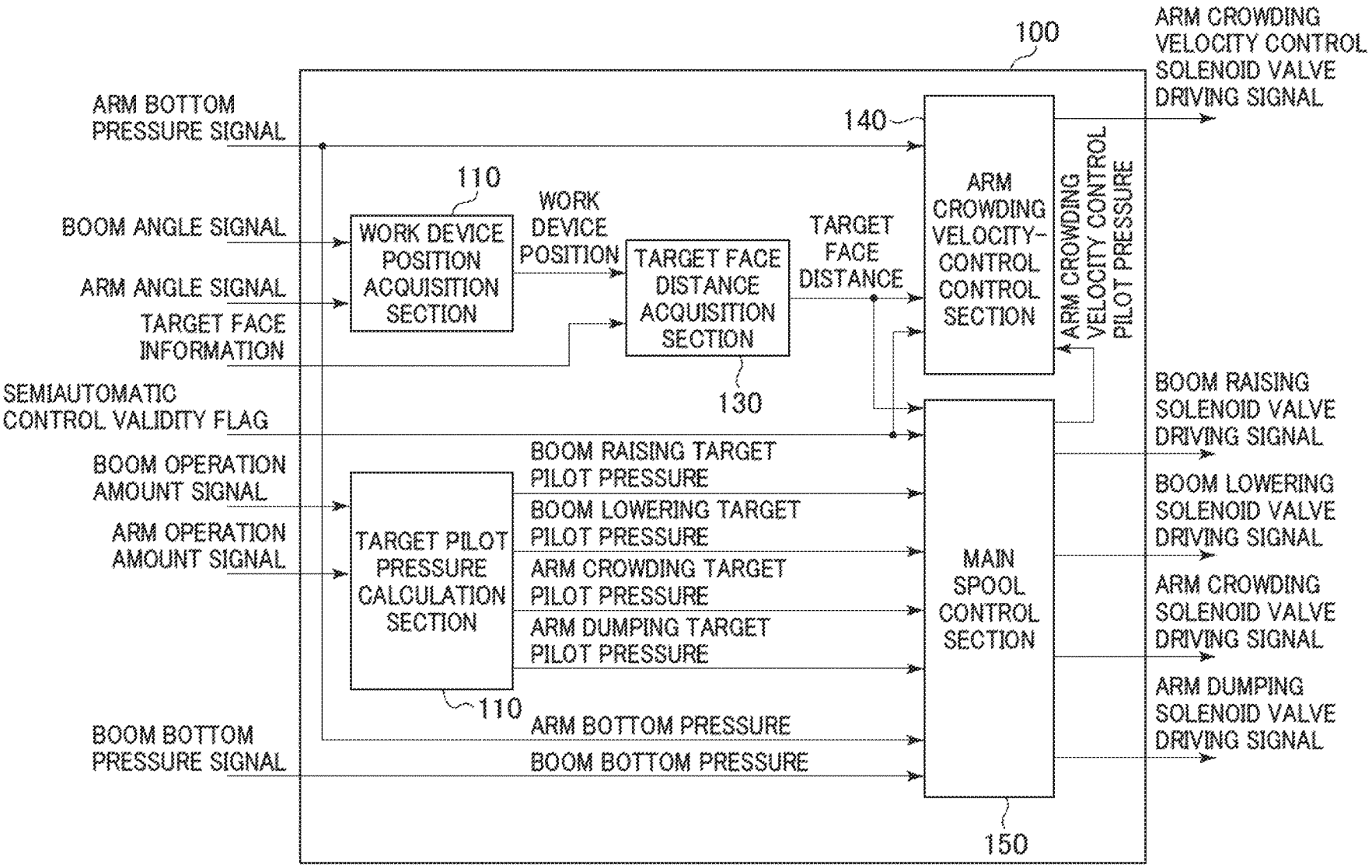
FIG. 3 is a control block diagram of a main controller depicted in FIG. 2.

FIG. 3 is a schematic block diagram of the main controller 100.

Referring to FIG. 3, the main controller 100 includes a target pilot pressure calculation section 110, a work device position acquisition section 120, a target face distance acquisition section 130, a main spool control section 140 and an arm crowding velocity-control control section 150.

The target pilot pressure calculation section 110 receives, as inputs thereto, a boom operation amount signal from the right operation lever device 1*c* and an arm operation amount signal from the left operation lever device 1*d*, and calculates and outputs to the main spool control section 140*a* boom raising target pilot pressure, a boom lowering target pilot pressure, an arm crowding target pilot pressure and an arm dumping target pilot pressure in response to the input signals. It is to be noted that, as the boom operation amount increases in the boom raising direction, the boom raising target pilot pressure is increased, and as the boom operation amount increases in the boom lowering direction, the boom lowering target pilot pressure is increased. Similarly, as the arm operation amount increases in the arm crowding direction, the arm crowding target pilot pressure is increased, and as the arm operation amount increases in the arm dumping direction, the arm dumping target pilot pressure is increased.

The work device position acquisition section 120 receives, as inputs thereto, a boom angle signal from the boom angle sensor 13*a* and an arm angle signal from the arm angle sensor 13*b*, calculates the distal end position of the bucket 8 using the boom angle and the arm angle as well as geometric information of the boom 11 and the arm 12 set in advance, and outputs the distal end position of the bucket 8 as a work device position to the target face distance acquisition section 130. Here, the work device position is calculated as one point, for example, in a coordinate system fixed to a hydraulic work machine. However, the work device position is not limited to this and may be calculated as a group of plural points taking the shape of the work device 15 into consideration.

The target face distance acquisition section 130 receives, as inputs thereto, target face information from the information controller 200 and the work device position from the work device position acquisition section 120, calculates the distance between the work device 15 and the construction target face (hereinafter referred to as target face distance), and outputs the target face distance to the main spool control section 140 and the arm crowding velocity-control control section 150. Here, the target face information is given, for example, as two points of a two-dimensional plane coordinate system fixed to a hydraulic work machine. However, although the target face information is not limited to this and may be given as three points that configure a plane in a global three-dimensional coordinate system, in this case, it is necessary to perform coordinate transformation to a coordinate system same as that of the work device position. Further, in the case where the work device position is calculated as a point group, the target face distance may be calculated using a point nearest to the target face information.

The main spool control section 140 receives, as inputs thereto, a semiautomatic control validity flag from the mode setting switch 32, a boom raising target pilot pressure, a boom lowering target pilot pressure, an arm crowding target pilot pressure and an arm dumping target pilot pressure from the target pilot pressure calculation section 110, an arm bottom pressure from the arm bottom pressure sensor 6*b*, a boom bottom pressure from the boom bottom pressure sensor 5*b* and a target face distance from the target face distance acquisition section 130. Then, in the case where the semiautomatic control validity flag is true, the target pilot pressures are corrected in response to a deviation of the arm bottom pressure from the boom bottom pressure and the target face distance, and a boom raising solenoid valve driving signal, a boom lowering solenoid valve driving signal, an arm crowding solenoid valve driving signal and an arm dumping solenoid valve driving signal according to the respective post-correction target pilot pressures are outputted to the solenoid proportional valves 21*a*, 21*b*, 23*a* and 23*b*, respectively. Details of the calculation performed by the main spool control section 140 are hereinafter described.

The arm crowding velocity-control control section 150 receives, as inputs thereto, a semiautomatic control validity flag from the mode setting switch 32, an arm crowding control pilot pressure from the main spool control section 140, a target face distance from the target face distance acquisition section 130, a boom bottom pressure from the boom bottom pressure sensor 5*b*, an arm bottom pressure from the arm bottom pressure sensor 6*b* and an arm crowding target pilot pressure from the main spool control section 140, corrects the arm crowding target pilot pressure in response to the boom bottom pressure and the arm bottom pressure, and outputs to the solenoid proportional valve 22*a* an arm crowding velocity-control solenoid valve driving signal according to the post-correction arm crowding target pilot pressure. Details of the calculation performed by the arm crowding velocity-control control section 150 are hereinafter described.

Figure 4:
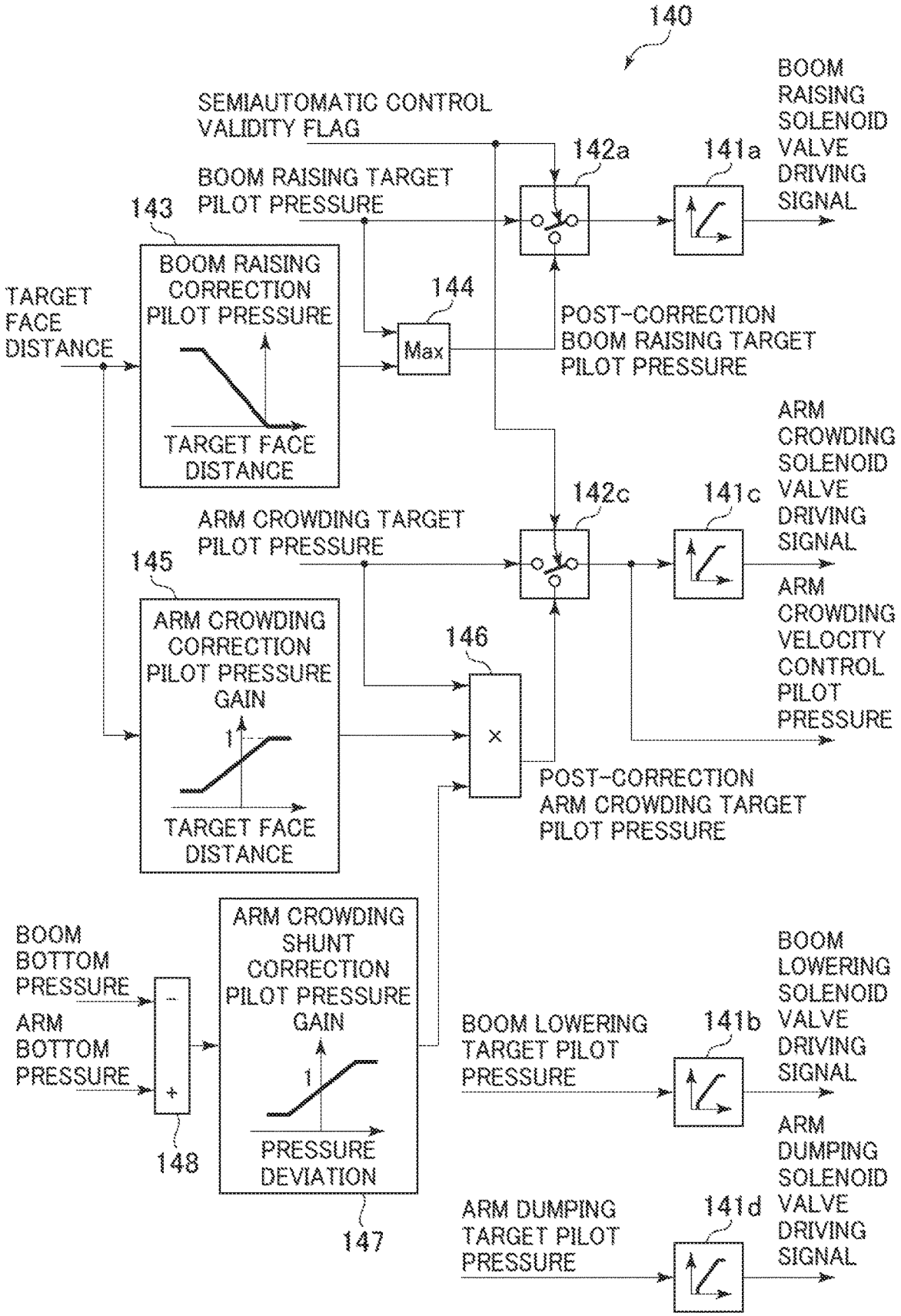
FIG. 4 is a calculation block diagram of a main spool control section depicted in FIG. 3.

FIG. 4 is a calculation block diagram of the main spool control section 140.

Referring to FIG. 4, the main spool control section 140 includes solenoid valve driving signal generating sections 141*a*, 141*b*, 141*c* and 141*d*, selecting sections 142*a* and 142*c*, a boom raising correction pilot pressure calculating section 143, a maximum value selecting section 144, an arm crowding correction pilot pressure gain calculating section 145, a multiplying section 146, an arm crowding shunt correction pilot pressure gain calculating section 147 and a subtracting section 148.

The solenoid valve driving signal generating section 141*a* refers to a table set in advance to generate a solenoid valve driving signal according to a boom raising target pilot pressure and outputs the solenoid valve driving signal to the solenoid proportional valve 21*a*. Similarly, the solenoid valve driving signal generating sections 141*b*, 141*c* and 141*d* generate solenoid valve driving signals according to a boom lowering target pilot pressure, an arm crowding target pilot pressure and an arm dumping target pilot pressure and output the solenoid valve driving signals to the solenoid proportional valves 21*b*, 23*a* and 23*b*, respectively.

The selecting section 142*a* selects, in the case where the semiautomatic control validity flag is false, the boom raising target pilot pressure from the target pilot pressure calculation section 110 and outputs the boom raising target pilot pressure to the solenoid valve driving signal generating section 141*a*. On the other hand, in the case where the semiautomatic control validity flag is true, the selecting section 142*a* selects the post-correction boom raising target pilot pressure from the maximum value selecting section 144 and outputs the post-correction boom raising target pilot pressure to the solenoid valve driving signal generating section 141*a*.

Similarly, in the case where the semiautomatic control validity flag is false, the selecting section 142*c* selects the arm crowding target pilot pressure from the target pilot pressure calculation section 110 and outputs the arm crowding target pilot pressure to the solenoid valve driving signal generating section 141*c* and the arm crowding velocity-control control section 150. On the other hand, in the case where the semiautomatic control validity flag is true, the selecting section 142*c* selects the post-correction arm crowding target pilot pressure from the multiplying section 146 and outputs the post-correction arm crowding target pilot pressure to the solenoid valve driving signal generating section 141*c* and further outputs to the arm crowding velocity-control control section 150 the post-correction arm crowding target pilot pressure as an arm crowding velocity-control pilot pressure.

The boom raising correction pilot pressure calculating section 143 refers to a table set in advance to calculate a boom raising correction pilot pressure according to a target face distance and outputs the boom raising correction pilot pressure to the maximum value selecting section 144. The maximum value selecting section 144 selects a maximum value from the inputs of the boom raising target pilot pressure and the boom raising correction pilot pressure and outputs the selected maximum value to the selecting section 142*a*. The table referred to by the boom raising correction pilot pressure calculating section 143 is set such that, as the target face distance increases in the negative direction, namely, as the work device 15 enters the target face more deeply, the boom raising correction pilot pressure increases. This makes it possible to perform a boom raising action in response to the target face distance and restrict entering of the work device 15 to the target face.

The arm crowding correction pilot pressure gain calculating section 145 refers to a table set in advance to calculate an arm crowding correction pilot pressure gain according to a target face distance and outputs the arm crowding correction pilot pressure gain to the multiplying section 146. The subtracting section 148 calculates and outputs to the multiplying section 146 the difference between an arm bottom pressure and a boom bottom pressure. The arm crowding shunt correction pilot pressure gain calculating section 147 refers to a table set in advance to calculate and output to the multiplying section 146 an arm crowding shunt correction pilot pressure gain according to a deviation of the arm bottom pressure from the boom bottom pressure. The multiplying section 146 multiplies the arm crowding target pilot pressure, arm crowding correction pilot pressure gain and the arm crowding shunt correction pilot pressure gain to correct the arm crowding target pilot pressure and outputs the corrected arm crowding target pilot pressure to the selecting section 142*c*.

The table referred to by the arm crowding correction pilot pressure gain calculating section 145 is set such that, as the target face distance increases in the negative direction, namely, as the work device 15 enters the target face more deeply, the arm crowding correction pilot pressure gain decreases. This makes it possible to decrease the arm crowding velocity in response to the decrease of the target face distance and restrict entering of the work device 15 to the target face.

The table referred to by the arm crowding shunt correction pilot pressure gain calculating section 147 is set such that, as the deviation of the arm bottom pressure from the boom bottom pressure increases, namely, as the excavation load increases, the arm crowding shunt correction pilot pressure gain increases. Since this increases, in the case where the exaction load is great, the meter-in opening of the arm cylinder 6, it is possible to prevent the shunt rate to the arm cylinder 6 from decreasing and maintain the velocity balance of the arm cylinder 6 and the boom cylinder 5.

Figure 5:
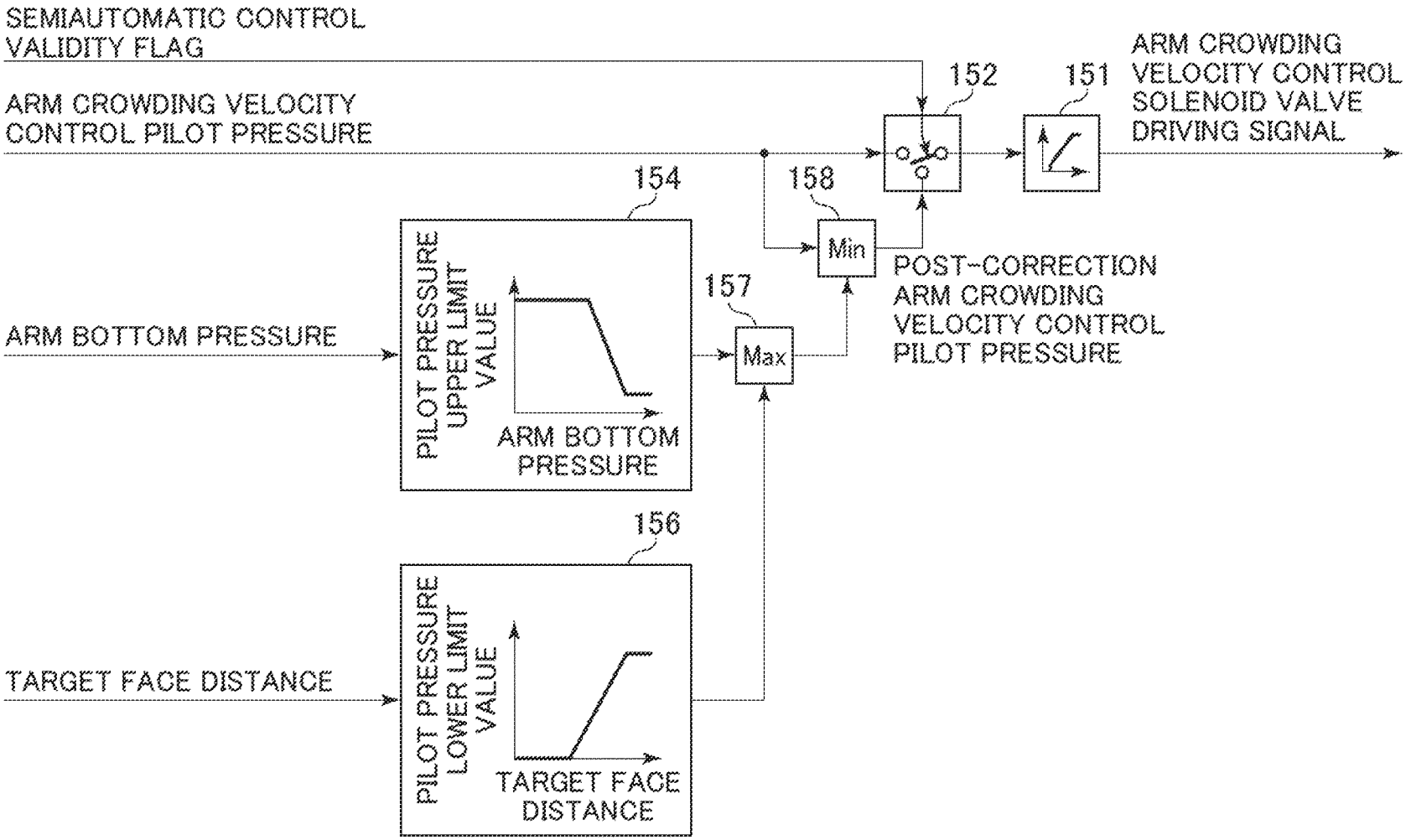
FIG. 5 is a calculation block diagram of an arm crowding velocity-control control section depicted in FIG. 3.

FIG. 5 is a control block diagram of the arm crowding velocity-control control section 150.

Referring to FIG. 5, the arm crowding velocity-control control section 150 includes a solenoid valve driving signal generating section 151, a selecting section 152, a pilot pressure upper limit value calculating section 154, a pilot pressure lower limit value calculating section 156, a maximum value selecting section 157 and a minimum value selecting section 158.

The solenoid valve driving signal generating section 151 refers to a table set in advance to generate an arm crowding velocity-control solenoid valve driving signal according to the arm crowding control pilot pressure and outputs the arm crowding velocity-control solenoid valve driving signal to the solenoid proportional valve 22*a*.

The selecting section 152 selects, in the case where the semiautomatic control validity flag is false, the arm crowding velocity-control pilot pressure and outputs the arm crowding velocity-control pilot pressure to the solenoid valve driving signal generating section 151. On the other hand, in the case where the semiautomatic control validity flag is true, the selecting section 152 selects a post-correction arm crowding velocity-control pilot pressure from the minimum value selecting section 158 hereinafter described and outputs the post-correction arm crowding velocity-control pilot pressure to the solenoid valve driving signal generating section 151.

The pilot pressure upper limit value calculating section 154 refers to a table set in advance to calculate a pilot pressure upper limit value according to the arm bottom pressure and outputs the pilot pressure upper limit value to the maximum value selecting section 157. The pilot pressure lower limit value calculating section 156 refers to a table set in advance to calculate a pilot pressure lower limit value according to the target face distance and outputs the pilot pressure lower limit value to the maximum value selecting section 157. The maximum value selecting section 157 selects a maximum value from the inputs of the pilot pressure upper limit value and a pilot pressure lower limit value from the pilot pressure lower limit value calculating section 156 hereinafter described to correct the pilot pressure upper limit value and outputs the corrected pilot pressure upper limit value to the minimum value selecting section 158. The minimum value selecting section 158 corrects the arm crowding velocity-control pilot pressure by selecting a minimum value from the inputs of the arm crowding control pilot pressure and the pilot pressure upper limit value and outputs the corrected arm crowding velocity-control pilot pressure to the selecting section 152.

The table referred to by the pilot pressure upper limit value calculating section 154 is set such that, as the arm bottom pressure increases, the pilot pressure upper limit value decreases. In particular, it is detected that the arm bottom pressure has increased, namely, that the excavation load has increased, and the arm crowding velocity-control pilot pressure generated by the solenoid proportional valve 22*a* is limited to limit the meter-out opening of the arm crowding velocity-control directional control valve 22. Since this limits the return flow rate from the arm cylinder 6, sudden acceleration of the arm 12 in the case where the excavation load decreases suddenly is prevented. It is to be noted that, since the control of the arm directional control valve 23 by the main spool control section 140 is executed independently of the control of the arm crowding velocity-control directional control valve 22 by the arm crowding velocity-control control section 150, even in the case where the arm crowding velocity-control pilot pressure is limited, the velocity balance of the arm cylinder 6 and the boom cylinder 5 can be maintained.

The table referred to by the pilot pressure lower limit value calculating section 156 is set such that, as the target face distance increases, the pilot pressure lower limit value increases. Since this decreases the reduction width of the meter-out opening of the arm crowding velocity-control directional control valve 22 as the distance of the distal end of the bucket 8 from the target face increases, the pressure loss caused by a meter-out throttle of the arm crowding velocity-control directional control valve 22 can be reduced.

Figure 6A:
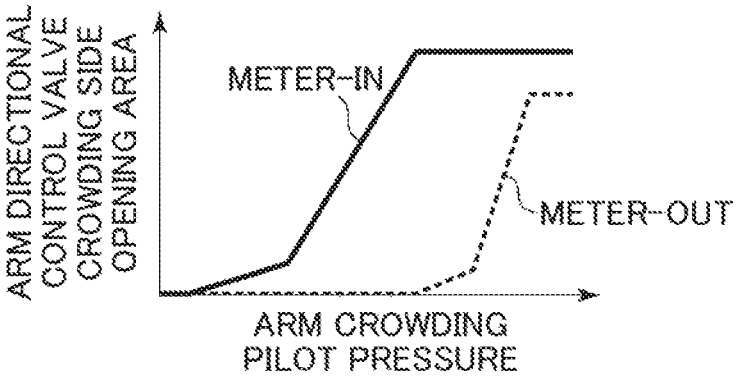
FIG. 6A is a view depicting an opening characteristic of an arm crowding side of an arm directional control valve depicted in FIG. 2.
Figure 6B:
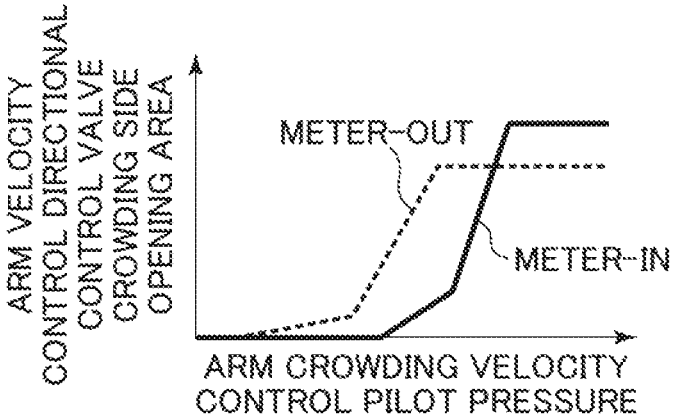
FIG. 6B is a view depicting an opening characteristic of the arm crowding side of an arm velocity-control directional control valve depicted in FIG. 2.

FIG. 6A is a view depicting an opening characteristic of the arm crowding side of the arm directional control valve 23, and FIG. 6B is a view depicting an opening characteristic of the arm crowding side of the arm crowding velocity-control directional control valve 22.

Referring to FIG. 6A, the arm directional control valve 23 is configured such that, in response to the increase of the arm crowding pilot pressure, the meter-in opening area begins to increase earlier than the meter-out opening area. In particular, the pilot pressure when the meter-in opening begins to open is set lower than the pilot pressure when the meter-out opening begins to open. On the other hand, the arm crowding velocity-control directional control valve 22 is configured such that, corresponding to the arm crowding velocity-control pilot pressure, the meter-out opening area begins to increase earlier than the meter-in opening area. In other words, the pilot pressure when the meter-out opening begins to open is set lower than the pilot pressure when the meter-in opening begins to open. Further, in the case where the meter-out opening area of the arm directional control valve 23 and the meter-out opening area of the arm crowding velocity-control directional control valve 22 are compared with each other, the meter-out opening area of the arm crowding velocity-control directional control valve 22 is configured so as to begin to increase earlier. In other words, the pilot pressure when the meter-in opening of the arm crowding velocity-control directional control valve 22 begins to open is set lower than the pilot pressure when the meter-out opening of the arm directional control valve 23 begins to open. By this setting, since, in a region in which the pilot pressure is low, namely, in a region in which the arm velocity is low, the meter-out opening area of the arm directional control valve 23 connected in parallel to the arm crowding velocity-control directional control valve 22 becomes zero, while meter-out control by the arm directional control valve 23 is disabled, it is possible to adjust the return flow rate from the arm cylinder 6 only by the arm crowding velocity-control directional control valve 22. Consequently, by correcting the arm crowding velocity-control pilot pressure so as to decrease in response to the increase of the excavation load, when the excavation load decreases suddenly, the back pressure of the arm cylinder 6 increases, and the flow rate of the hydraulic fluid to be supplied to the arm cylinder 6 is suppressed and sudden acceleration of the arm 12 is prevented.

Advantages obtained by the present embodiment configured in such a manner as described above are described in comparison with prior art.

Figure 7A:
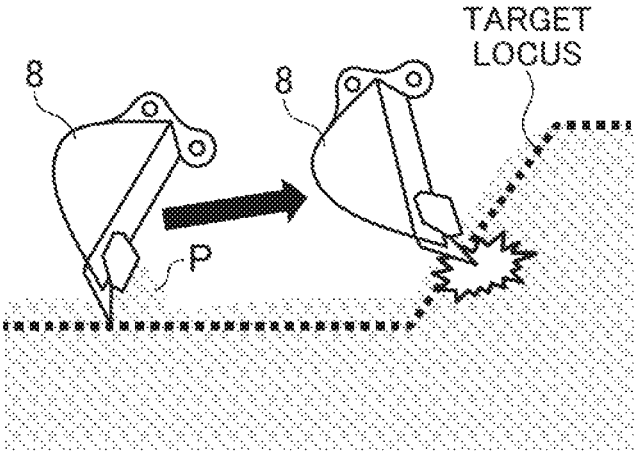
FIG. 7A (PRIOR ART)
FIG. 7A is a view depicting excavation action by a hydraulic excavator according to a prior art.
Figure 7B:
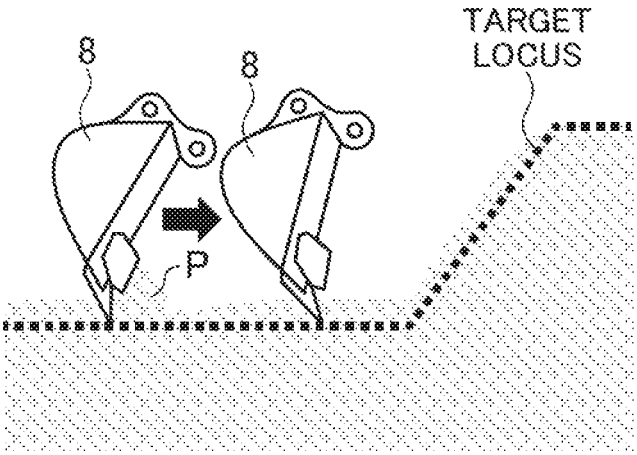
FIG. 7B is a view depicting excavation action by the hydraulic excavator depicted in FIG. 1.

FIG. 7A is a view depicting an excavation action by a hydraulic excavator according to prior art, and FIG. 7B is a view depicting an excavation action by the hydraulic excavator 300 according to the present embodiment.

Referring to FIG. 7A, if the distal end of the bucket 8 collides with a protuberance P projecting significantly from a target locus while it is moving along the target locus, then the operation amount of the arm directional control valve 23 is corrected to increase such that the meter-in opening of the arm directional control valve 23 increases in response to the increase of the deviation of the arm bottom pressure with respect to the boom bottom pressure (or excavation load). Consequently, even in a state in which the excavation load increases, the velocity balance of the arm cylinder 6 and the boom cylinder 5 is maintained and the distal end of the bucket 8 can be moved along the target locus. However, there is a risk that, immediately after the distal end of the bucket 8 passes the protuberance P, the excavation load decreases suddenly and a large amount of hydraulic fluid is supplied to the bottom side of the arm cylinder 6 through the meter-in opening of the arm directional control valve 23, resulting in the possibility that the arm 12 (depicted in FIG. 1) may be accelerated suddenly in the crowding direction. As a result, the distal end of the bucket 8 is deviated significantly from the target locus, and in the case where the advancing direction of the distal end of the bucket 8 and the target locus cross with each other, the bucket 8 excavates more deeply than the target locus.

On the other hand, with the hydraulic excavator 300 according to the present embodiment, when the operation amount of the arm directional control valve 23 is corrected to increase in response to the increase of the deviation of the arm bottom pressure with respect to the boom bottom pressure (or excavation load), the meter-out opening of the arm crowding velocity-control directional control valve 33 is throttled. Consequently, the velocity balance of the arm cylinder 6 and the boom cylinder 5 in a state in which the excavation load increases is maintained, and when the excavation load decreases suddenly, the back pressure of the arm cylinder 6 increases and the flow rate of the hydraulic fluid to be supplied to the arm cylinder 6 is suppressed. As a result, since sudden acceleration of the arm 12 immediately after the distal end of the bucket 8 passes the protuberance P is suppressed, the distal end of the bucket 8 can be prevented from being deviated by a great amount from the target locus as depicted in FIG. 7B.

According to the present embodiment configured in such a manner as described above, by preventing sudden acceleration of the arm 12 when the excavation load decreases suddenly in the hydraulic excavator 300 of a two-pump type, the finishing accuracy in a horizontally leveling work, a slope face shaping work and so forth can be improved.

Second Embodiment

Figure 8:
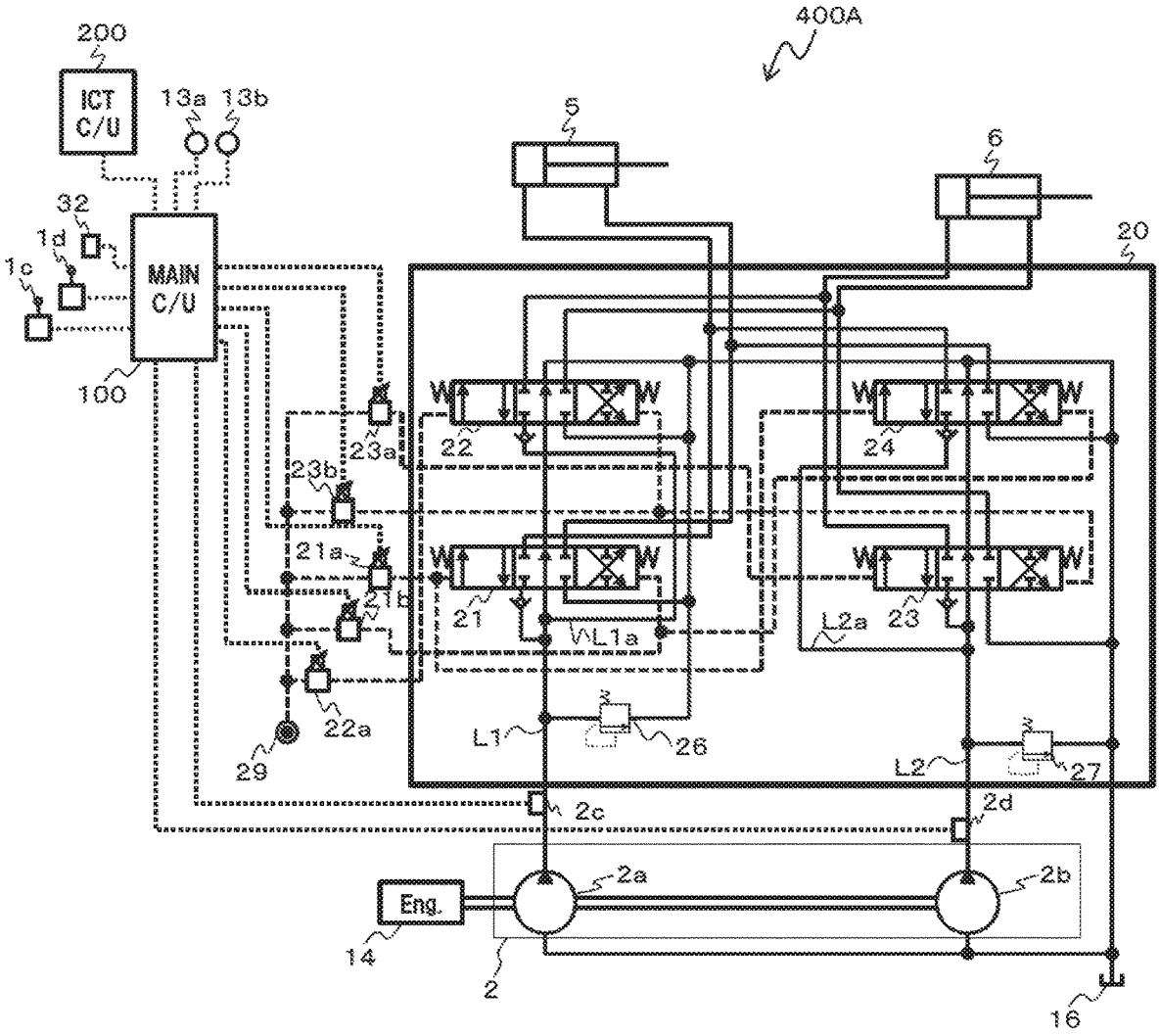
FIG. 8 is a schematic block diagram of a hydraulic drive system incorporated in a hydraulic excavator according to a second embodiment of the present invention.

FIG. 8 is a schematic block diagram of a hydraulic drive system incorporated in a hydraulic excavator according to a second embodiment of the present invention. In the following, description is given focusing on the differences from the first embodiment.

Referring to FIG. 8, a hydraulic drive system 400A according to the present embodiment includes a first pump delivery pressure sensor 2*c* attached to the first pump line L1 in which the first boom directional control valve 21 is arranged in place of the boom bottom pressure sensor 5*b* (depicted in FIG. 2) and includes a second pump delivery pressure sensor 2*d* attached to the second pump line L2 in which the arm directional control valve 23 is arranged in place of the arm bottom pressure sensor 6*b* (depicted in FIG. 2).

Pressure signals of the pump delivery pressure sensors 2*c* and 2*d* are inputted to the main controller 100. The delivery pressure of the first hydraulic pump 2*a* changes in an interlocking relationship with the boom bottom pressure while the delivery pressure of the second hydraulic pump 2*b* changes in an interlocking relationship with the arm bottom pressure. Therefore, the main controller 100 can substitute the delivery pressure of the first hydraulic pump 2*a* for the boom bottom pressure and can substitute the delivery pressure of the second hydraulic pump 2*b* for the arm bottom pressure. In other words, the first pump delivery pressure sensor 2*c* configures a boom load pressure sensor, and the second pump delivery pressure sensor 2*d* configures an arm load pressure sensor.

Also with the present embodiment configured in such a manner as described above, similar advantages to those by the first embodiment can be obtained.

Further, since the boom load pressure sensor 2*c* and the arm load pressure sensor 2*d* in the present embodiment are arranged in the machine chamber of the upper swing structure 10 similarly to the hydraulic pumps 2*a* and 2*b*, they can be attached more readily than the boom load pressure sensor 5*b* and the arm load pressure sensor 6*b* (depicted in FIG. 2) in the first embodiment.

Further, since the installation environment of the boom load pressure sensor 2*c* and the arm load pressure sensor 2*d* in the present embodiment is not so severe as that of the boom load pressure sensor 5*b* and the arm load pressure sensor 6*b* (depicted in FIG. 2) in the first embodiment, the service life of the boom load pressure sensor 2*c* and the arm load pressure sensor 2*d* can be extended from that in the first embodiment.

Third Embodiment

Figure 9:
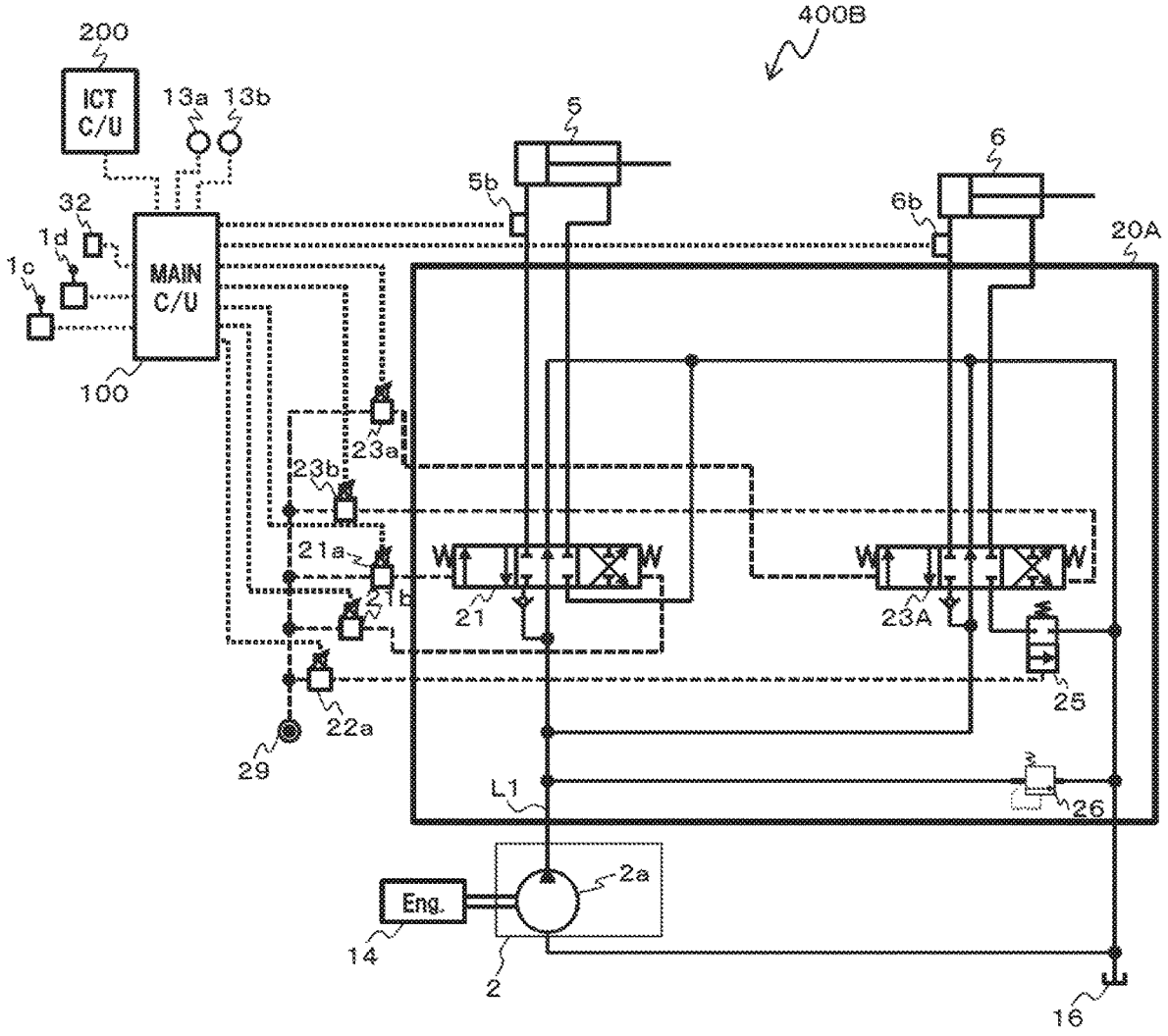
FIG. 9 is a schematic block diagram of a hydraulic drive system incorporated in a hydraulic excavator according to a third embodiment of the present invention.

FIG. 9 is a schematic block diagram of a hydraulic drive system incorporated in a hydraulic excavator according to a third embodiment of the present invention. In the following, description is given focusing on the differences from the first embodiment.

Referring to FIG. 9, a hydraulic drive system 400B is a one-pump type hydraulic drive system and is configured such that, from the hydraulic drive system 400 in the first embodiment, the second hydraulic pump 2*b*, second boom directional control valve 24 and arm crowding velocity-control directional control valve 22 and the second pump line L2, parallel circuit L2*a* and relief valve 27 ancillary to them are removed while an arm crowding velocity-control on-off valve 25 as an arm velocity-control valve device is provided in a line that connects the meter-out side of the arm directional control valve 23 and a hydraulic operating fluid tank 16.

In the control valve 20A, the boom directional control valve 21 and the arm directional control valve 23 are connected to the first pump line L1, and the hydraulic fluid delivered from the first hydraulic pump 2*a* is supplied to the boom cylinder 5 and the arm cylinder 6. The first boom directional control valve 21 and the arm directional control valve 23 are connected in parallel to the first hydraulic pump 2*a* and configured in such a way as to be capable of shunting.

Figure 10A:
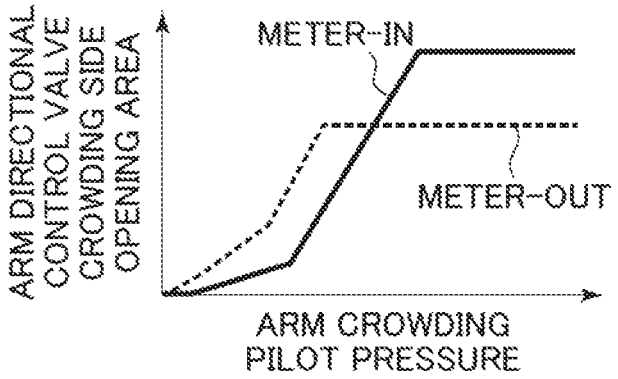
FIG. 10A is a view depicting an example of an opening characteristic of an arm directional control valve depicted in FIG. 9.
Figure 10B:
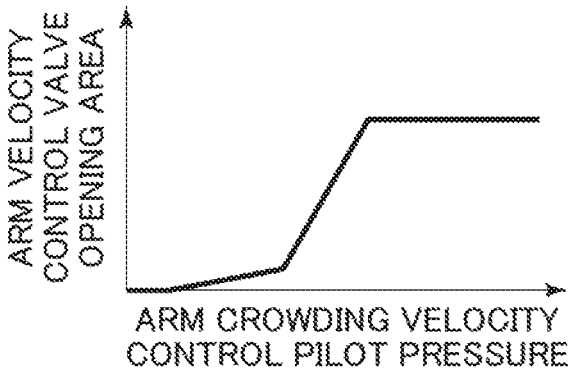
FIG. 10B is a view depicting an example of a control characteristic of an arm velocity-control valve depicted in FIG. 9.

FIG. 10A is a view depicting an opening characteristic of the arm crowding side of an arm directional control valve 23A, and FIG. 10B is a view depicting an opening characteristic of the arm crowding velocity-control on-off valve 25.

Referring to FIG. 10A, the arm directional control valve 23 is configured such that, in response to the increase of the arm crowding pilot pressure, the meter-out opening area begins to increase earlier than the meter-in opening area. In particular, the pilot pressure when the meter-out opening begins to open is set lower than the pilot pressure when the meter-in opening begins to open. Further, in the case where the meter-out opening area of the arm directional control valve 23 and the opening area of the arm crowding velocity-control on-off valve 25 are compared with each other, the opening area of the arm crowding velocity-control on-off valve 25 is configured so as to begin to increase later. In other words, the pilot pressure when the arm crowding velocity-control on-off valve 25 begins to open is set higher than the pilot pressure when the meter-in opening of the arm directional control valve 23 begins to open. By this setting, in a region in which the pilot pressure is low, namely, in a region in which the arm velocity is low, the opening area of the arm crowding velocity-control on-off valve 25 connected in series to the arm directional control valve 23 is smaller than the meter-out opening area of the arm directional control valve 23. Therefore, while meter-out control by the arm directional control valve 23 is disabled, it is possible to adjust the returning flow rate from the arm cylinder 6 only by the arm crowding velocity-control on-off valve 25. Consequently, by correcting the arm crowding velocity-control pilot pressure to decrease in response to the increase of the excavation load, when the excavation load decreases suddenly, the back pressure of the arm cylinder 6 increases and the flow rate of the hydraulic fluid to be supplied to the arm cylinder 6 is suppressed and sudden acceleration of the arm 12 is prevented.

With the present embodiment configured in such a manner as described above, by preventing sudden acceleration of the arm 12 when the excavation load decreases suddenly in the one-pump type hydraulic excavator, the finishing accuracy in a horizontally leveling work, a slope face shaping work and so forth can be improved.

Further, since the reduction width of the opening of the arm crowding velocity-control on-off valve 25 decreases as the distance of the distal end of the bucket 8 from the target face increases, pressure loss caused by a throttle of the arm crowding velocity-control on-off valve 25 can be reduced.

Although the embodiments of the present invention have been described in detail, the present invention is not limited to the embodiments described above and includes various modifications. For example, the embodiments described above are detailed explanations for describing the present invention such that it can be recognized readily and are not necessarily limited to the configurations that include all components described in connection with the embodiments described above. Also it is possible to add part of the components of a certain embodiment to the components of a different embodiment, and also it is possible to delete some of the components of a certain embodiment or to replace part of the components of a certain embodiment, with part of the components of a different embodiment.

DESCRIPTION OF REFERENCE CHARACTERS

1*a*: Traveling right operation lever device
1*b*: Traveling left operation lever device
1*c*: Right operation lever device (boom operation device)
1*d*: Left operation lever device (arm operation device)
2: Hydraulic pump device
2*a*: First hydraulic pump
2*b*: Second hydraulic pump
2*c*: First pump delivery pressure sensor (boom load pressure sensor)
2*d*: Second pump delivery pressure sensor (arm load pressure sensor)
3: Travelling hydraulic motor
4: Swinging hydraulic motor
5: Boom cylinder
5*b*: Boom bottom pressure sensor (boom load pressure sensor)
6: Arm cylinder
6*b*: Arm bottom pressure sensor (arm load pressure sensor)
7: Bucket cylinder
8: Bucket
9: Lower track structure
10: Upper swing structure
11: Boom
12: Arm
13*a*: Boom angle sensor
13*b*: Arm angle sensor
13*c*: Bucket angle sensor
14: Engine
15: Work device
16: Hydraulic operating fluid tank
20: Control valve
21: First boom directional control valve
21*a*, 21*b*: Solenoid proportional valve
22: Arm crowding velocity-control directional control valve (second arm directional control valve, arm velocity-control valve device)
22*a*: Solenoid proportional valve
23, 23A: Arm directional control valve (first arm directional control valve)
23*a*, 23*b*: Solenoid proportional valve
24: Second boom directional control valve
25: Arm crowding velocity-control on-off valve (arm velocity-control valve device)
26: Relief valve
27: Relief valve
29: Pilot hydraulic fluid source
32: Mode setting switch
100: Main controller (controller)
110: Target pilot pressure calculation section
120: Work device position acquisition section
130: Target face distance acquisition section
140: Main spool control section

141*a* to 141*d*: Solenoid valve driving signal generating section
142*a*, 142*c*: Selecting section
143: Boom raising correction pilot pressure calculating section
144: Maximum value selecting section
145: Arm crowding correction pilot pressure gain calculating section
146: Multiplying section
147: Arm crowding shunt correction pilot pressure gain calculating section
148: Subtracting section
150: Arm crowding velocity-control control section
151: Solenoid valve driving signal generating section
152: Selecting section
154: Pilot pressure upper limit value calculating section
156: Pilot pressure lower limit value calculating section
157: Maximum value selecting section
158: Minimum value selecting section
200: Information controller
300: Hydraulic excavator
400, 400A, 400B: Hydraulic drive system
L1: First pump line
L1*a*: Parallel circuit
L2: Second pump line
L2*a*: Parallel circuit
P: Protuberance

The invention claimed is:

1. A hydraulic work machine, comprising:
a work device including a boom and an arm;
a boom cylinder that drives the boom;
an arm cylinder that drives the arm;
a hydraulic operating fluid tank;
a first hydraulic pump;
a first boom directional control valve that controls a flow rate and a direction of hydraulic fluid to be supplied from the first hydraulic pump to the boom cylinder;
a first arm directional control valve that controls a flow rate and a direction of hydraulic fluid to be supplied from the first hydraulic pump to the arm cylinder;
a boom operation device that gives instructions on an operation amount of the first boom directional control valve;
an arm operation device that gives instructions on an operation amount of the first arm directional control valve;
a boom load pressure sensor that detects a load pressure of the boom cylinder;
an arm load pressure sensor that detects a load pressure of the arm cylinder; and
a controller configured to correct and increase an operation amount of the first arm directional control valve, the operation amount being instructed by the arm operation device, such that a meter-in opening of the arm cylinder increases in response to the increase of a deviation of the load pressure of the arm cylinder with respect to the load pressure of the boom cylinder, wherein
the hydraulic work machine further comprises an arm velocity-control valve device capable of adjusting a meter-out opening of the arm cylinder independently of the first arm directional control valve, and
the controller is configured to control, when correcting and increasing the operation amount instructed by the arm operation device, the arm velocity-control valve device to decrease the meter-out opening of the arm cylinder in response to the increase of the load pressure of the arm cylinder.

2. The hydraulic work machine according to claim 1, wherein
the arm velocity-control valve device is an on-off valve provided in a line that connects the first arm directional control valve and the hydraulic operating fluid tank.

3. The hydraulic work machine according to claim 1, wherein
the controller is configured to calculate a target face distance that is a distance between the work device and a working target face, and controls the arm velocity-control valve device such that, when correcting and increasing the operation amount instructed by the arm operation device, a reduction width of the meter-out opening of the arm cylinder according to the increase of the load pressure of the arm cylinder decreases in response to the increase of the target face distance.

4. A hydraulic work machine, comprising:
a work device including a boom and an arm;
a boom cylinder that drives the boom;
an arm cylinder that drives the arm;
a hydraulic operating fluid tank;
a first hydraulic pump;
a second hydraulic pump;
a first boom directional control valve that controls a flow rate and a direction of hydraulic fluid to be supplied from the first hydraulic pump to the boom cylinder;
a first arm directional control valve that controls a flow rate and a direction of hydraulic fluid to be supplied from the second hydraulic pump to the arm cylinder;
a second boom directional control valve that controls a flow rate and a direction of hydraulic fluid to be supplied from the second hydraulic pump to the boom cylinder;
a second arm directional control valve that controls a flow rate and a direction of hydraulic fluid to be supplied from the first hydraulic pump to the arm cylinder;
a boom operation device that gives instructions on an operation amount of the first boom directional control valve and the second boom directional control valve;
an arm operation device that gives instructions on an operation amount of the first arm directional control valve and the second arm directional control valve;
a boom load pressure sensor that detects a load pressure of the boom cylinder;
an arm load pressure sensor that detects a load pressure of the arm cylinder; and
a controller configured to correct and increase an operation amount of the first arm directional control valve, the operation amount being instructed by the arm operation device, such that a meter-in opening of the arm cylinder increases in response to the increase of a deviation of the load pressure of the arm cylinder with respect to the load pressure of the boom cylinder, wherein
the second arm directional control valve is configured such that a meter-out opening thereof begins to open by an operation amount smaller than an operation amount when a meter-out opening of the first arm directional control valve begins to open, and
the controller is configured to control, when correcting and increasing the operation amount instructed by the arm operation device, the operation amount of the second arm directional control valve to decrease in response to the increase of the load pressure of the arm cylinder.

* * * * *